US011391532B2

(12) United States Patent
Markut et al.

(10) Patent No.: US 11,391,532 B2
(45) Date of Patent: Jul. 19, 2022

(54) ADAPTER FOR MOUNTING AN ACCESSORY ON A FIREARM

(71) Applicant: GLOCK TECHNOLOGY GMBH, Ferlach (AT)

(72) Inventors: Karl Markut, Klagenfurt (AT); Patrick Nolte, Klagenfurt (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 0 days.

(21) Appl. No.: 17/120,695

(22) Filed: Dec. 14, 2020

(65) Prior Publication Data

US 2021/0180903 A1 Jun. 17, 2021

(30) Foreign Application Priority Data

Dec. 13, 2019 (EP) ..... 19215974

(51) Int. Cl.
*F41A 21/32* (2006.01)
*F41A 21/30* (2006.01)
*F41A 21/48* (2006.01)

(52) U.S. Cl.
CPC ..... *F41A 21/325* (2013.01); *F41A 21/30* (2013.01); *F41A 21/481* (2013.01); *F41A 21/484* (2013.01); *F41A 21/485* (2013.01)

(58) Field of Classification Search
CPC ..... F41A 21/32; F41A 21/325; F41A 21/30; F41A 21/481; F41C 23/16
See application file for complete search history.

(56) References Cited

U.S. PATENT DOCUMENTS 968,583 A * 8/1910 Michaud ..... F41A 21/40 42/79
985,308 A * 2/1911 Van Voorhis ..... F41A 21/40 285/396
2,880,435 A * 4/1959 Deutsch ..... E03F 9/002 403/349
4,887,929 A * 12/1989 Hale ..... F16D 1/108 403/14

(Continued)

FOREIGN PATENT DOCUMENTS

WO 2009139803 A2 11/2009

OTHER PUBLICATIONS

Search Report established in related EP Application 19215974.7-1011, dated May 29, 2020.

*Primary Examiner* — Derrick R Morgan
(74) *Attorney, Agent, or Firm* — Raven Patents, LLC; Anton E. Skaugset

(57) ABSTRACT

Adapters for mounting an accessory on a firearm, firearm accessories configured to mount to those adapters, and sheath or handguard assemblies of firearms are disclosed. The recited accessory adapter is substantially annular or tubular in shape, and includes at least two portions that are arranged adjacently along the barrel axis of the firearm. A rear portion is formed on the weapon side of the adapter, so that the rear portion is geometrically complementary to the front end of a firearm sheath, at least in part, and a front portion of the adapter includes a cylindrical coupling surface on the outside for coupling of the accessory, where the coupling surface includes at least one bayonet extension that projects radially outwards.

15 Claims, 6 Drawing Sheets

(56) References Cited

U.S. PATENT DOCUMENTS

| | | | | | |
|---|---|---|---|---|---|
| 4,893,426 | A * | 1/1990 | Bixler | F41A 21/325 | 89/14.05 |
| 4,920,679 | A * | 5/1990 | Sarles | F41A 21/481 | 42/75.02 |
| 5,271,312 | A * | 12/1993 | Lishness | F41A 21/481 | 89/14.05 |
| 5,433,133 | A * | 7/1995 | La France | F41A 21/325 | 89/14.2 |
| 5,559,302 | A * | 9/1996 | Latka | F41A 21/325 | 89/14.05 |
| 9,021,673 | B2 * | 5/2015 | Ray | A41D 19/0037 | 29/270 |
| 9,513,078 | B1 * | 12/2016 | Fulton | F41A 21/325 | |
| 9,658,010 | B1 * | 5/2017 | Oglesby | F41C 23/16 | |
| 11,047,640 | B1 * | 6/2021 | Lee | F41A 21/44 | |
| 11,187,474 | B2 * | 11/2021 | Masters | F41A 3/66 | |
| 2008/0148928 | A1 * | 6/2008 | McClellan | F41A 21/30 | 89/14.4 |
| 2013/0133976 | A1 * | 5/2013 | Johansen | F41A 21/325 | 181/223 |
| 2015/0253098 | A1 * | 9/2015 | Russell | F41A 21/30 | 89/14.4 |
| 2017/0160037 | A1 * | 6/2017 | Gray | F41A 21/482 | |
| 2018/0245872 | A1 * | 8/2018 | Jen | F41A 21/325 | |
| 2019/0072354 | A1 * | 3/2019 | Lee | F41A 21/325 | |
| 2019/0204040 | A1 * | 7/2019 | Mackey | F41A 21/481 | |
| 2021/0164749 | A1 * | 6/2021 | Mackey | F41A 21/481 | |
| 2021/0389074 | A1 * | 12/2021 | Reis-Green | F41A 21/30 | |

* cited by examiner

ADAPTER FOR MOUNTING AN ACCESSORY ON A FIREARM

TECHNICAL FIELD

The present disclosure relates to the mounting of accessories on firearms. More particularly, the disclosure relates to adapters for mounting an accessory on a firearm, such as an assault rifle.

BACKGROUND

Firearm accessories, or accessory parts, can include any of a wide variety of devices designed to couple with or attach to a firearm. Some common firearm accessories include sights, scopes, illumination sources, sound suppressors or silencers, muzzle brakes, and flash dampers, among others. Such accessories may require an accessory adapter in order to mount the accessory to the intended firearm.

Published patent application US 2019/072354 A1 (hereby incorporated by reference for all purposes) discloses an adapter that has considerable length in the direction of the barrel, is mounted and fixed on a sheath of a firearm with protrusions. A threaded part on the front end of the adapter cooperates with a threaded part on the rear end of the accessory. This system is voluminous and requires rotation of the adapter to attach, which can be cumbersome and undesirable when in the field.

Published patent application US 2013/133976 A1 (hereby incorporated by reference for all purposes) discloses a silencer which is mounted directly at the front end of a barrel without a sheath and with the help of a bayonet-like attachment mechanism.

When fired in fully automatic mode, contemporary assault rifles can have a firing rate of several hundred rounds per minute. Under such conditions, rapid dissipation of the generated heat is required, and was accomplished by the attachment of a variety of different sheaths on the barrels of such rifles. For example, the front stocks of AR-15-style rifles are frequently designed as perforated and usually two-part "handguards." These handguards are arranged so as to be at a distance from the barrel, protecting the user from direct contact with the hot barrel, while simultaneously allowing airflow to enhance cooling. Silencers, also incorporated devices for blocking heat transport to the outer surface, and such covers often rested directly on the silencer.

When an accessory is to be mounted to the barrel of a firearm, two problems occur: First, any attachment of an accessory to the barrel end increases the problem of heat dissipation from the barrel, since the escape of gas into the surroundings at the end of the barrel can no longer take place unimpeded, leading to rapid and significant heating of the accessory. Particularly in the case of silencers, which operate by reducing the speed of emerging combustion gases to below the speed of sound, it is difficult to conduct away the energy, which is converted into heat in the process. This also applies, to an only slightly lesser extent, for other muzzle attachments.

Although the following discussion is in the context of an accessory silencer, this is merely used as an example in order to more clearly explain the attachment of an accessory. In order to cover a silencer to the outside, both to protect the user and in order that an adversary cannot easily identify the "thermal signal" of the silencer after one shot, or at the latest after a plurality of shots, a silencer should preferably be thermally shielded with respect to the surroundings. In the prior art, a suitable cover may be fastened directly to the silencer and referred to as the "suppressor cover." A cover of this kind which is directly fastened to a silencer, a muzzle brake, or the like, increases the mass and weight that acts on the coupling point to the barrel, as a result of which the precision of the weapon suffers, as does the mechanical load thereof.

What is needed is an improved attachment (mounting) of accessories such as shields of silencers, muzzle brakes, flash hiders (also referred to as "flash dampers"), lights, and other accessories on the weapon. As previously explained, in the prior art said accessory components are generally fastened directly at the front of the barrel, on the muzzle thereof. Such attachments would benefit from improved support and/or retention of a heat shield surrounding the barrel.

SUMMARY

The present invention includes adapters for mounting an accessory, or accessory part, to a firearm; firearm sheaths compatible with such adapters, and accessories configured to be compatible with such adapters.

In one embodiment the invention includes an adapter for mounting an accessory on a sheath of a firearm, where the firearm defines a barrel axis, and the adapter includes at least two portions that are arranged adjacently along the barrel axis; the at least two portions including a rear portion configured to be adjacent the firearm and formed so as to be geometrically complementary to at least a portion of a front end of the sheath; and a front portion configured to be adjacent the accessory and including a cylindrical coupling surface on an outside of the front portion and configured to couple with the accessory. The adapter is substantially annular or tubular in shape, and includes at least one bayonet extension on the cylindrical coupling surface that projects radially outwards, and at least one spring-loaded push button on the coupling surface.

In one embodiment, the invention includes a sheath for a barrel of a firearm, where the firearm defines a barrel axis, and the sheath includes a sheath front portion that is geometrically complementary to a rear portion of an accessory adapter; where the adapter includes at least two portions that are arranged adjacently along the barrel axis; the at least two portions including a rear portion configured to be adjacent the firearm and formed so as to be geometrically complementary to at least the front portion of the sheath; and a front portion configured to be adjacent an accessory and including a cylindrical coupling surface on an outside of the front portion and configured to couple with the accessory; and where the adapter is substantially annular or tubular in shape, and includes at least one bayonet extension on the cylindrical coupling surface that projects radially outwards, and at least one spring-loaded push button on the coupling surface.

In one embodiment, the invention includes a sheath for a barrel of a firearm, where the firearm defines a barrel axis, the sheath including a sheath front region, and a handguard. The front portion of the sheath includes a front portion of an accessory adapter that is formed integrally on the handguard, the front portion of the accessory adapter being further configured to be adjacent an accessory and including a cylindrical coupling surface on an outside of the front portion and configured to couple with the accessory; where the accessory adapter is substantially annular or tubular in shape, and includes at least one bayonet extension on the cylindrical coupling surface that projects radially outwards, and at least one spring-loaded push button on the coupling surface.

In one embodiment, the invention includes a firearm accessory, including a shroud formed on an end region of the accessory, on a weapon side of the accessory, configured to couple with an accessory adapter or a sheath; where the accessory adapter includes at least two portions that are arranged adjacently along a barrel axis of a firearm; the at least two portions including a rear portion configured to be adjacent the firearm and formed so as to be geometrically complementary to at least a portion of a front end of the sheath; and a front portion configured to be adjacent the accessory and including a cylindrical coupling surface on an outside of the front portion and configured to couple with the accessory. The accessory adapter is substantially annular or tubular in shape, and includes at least one bayonet extension on the cylindrical coupling surface that projects radially outwards, and at least one spring-loaded push button on the coupling surface. The front portion of the sheath includes a front portion of the accessory adapter that is formed integrally on the handguard, the front portion of the accessory adapter being further configured to be adjacent the accessory and including a cylindrical coupling surface on an outside of the front portion and configured to couple with the accessory.

DETAILED DESCRIPTION

In the context of the disclosed invention, reference may be made, by way of simplification, to a sheath, a handguard, and various other components such as a barrel, and/or handguard clamp also being included. Reference may also made, by way of simplification, to the front stock, this likewise being intended to specify a synonym for the sheath.

In the light of the present disclosure, a person having ordinary skill in the art and the benefit of the disclosure would well understand how to integrate presently disclosed adapter, if necessary, with the disclosed coupling connection, in a specifically-designed sheath, or a correspondingly-adapted handguard. As an example, the bayonet joint could also be formed directly on the sheath of the barrel, as a result of which the mechanical stability can be further improved.

As a central feature, an adapter for attaching (any desired) accessory part can be provided on the handguard, the barrel sheath. With respect to the firearm the adapter is geometrically adapted to the sheath, and it is also geometrically adapted to and can be coupled to the accessory part. The coupling connection between the adapter and the accessory part is preferably designed as a bayonet joint, and can comprise an additional securing means, such as one or more push buttons. The geometry with respect to the weapon is specified by the usually already existing sheath, and does not require any detailed explanation.

Figure 1A:
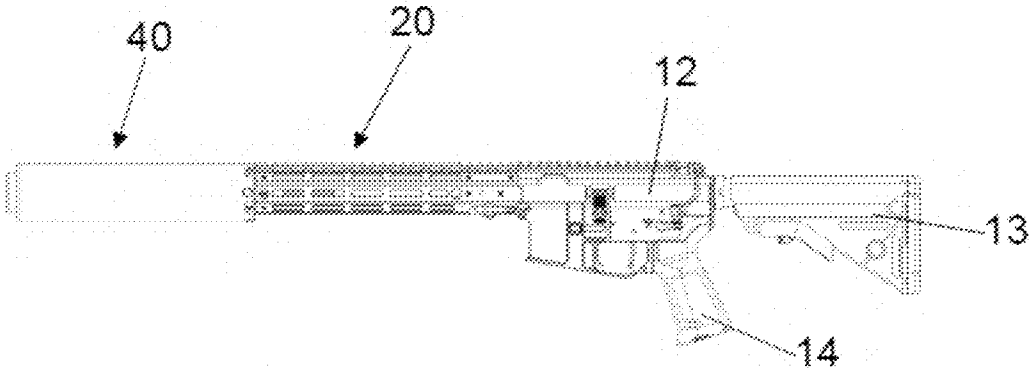
FIG. 1A is a side view of an exemplary firearm equipped in a manner according to the present disclosure.

For the purposes of overview, FIG. 1A is a side view of a weapon equipped according to the present disclosure comprising a sheath ("handguard assembly") 20, a housing ("receiver") 12, a stock 13, a grip 10, and an accessory part 40, generally denoted merely "accessory" in the following, that is fastened to the sheath 20.

The selected embodiment of the accessory part 40 is based on a shield of a silencer and is intentionally shown in a very simplified manner. In the light of the disclosure a person skilled in the art can transfer, mutatis mutandis, the coupling illustrated by the present disclosure of an accessory part 40, such as lamps, sights or other accessories. For this reason, the accessory part 40 is shown as a simple cylinder, without possible further design features, and the necessary details are specified only in the region of the mounting. This is due to the fact that, with the exception of said features that are relevant for the fastening, the design of the accessory 40 is not a critical aspect of the present disclosure.

Figure 1B:
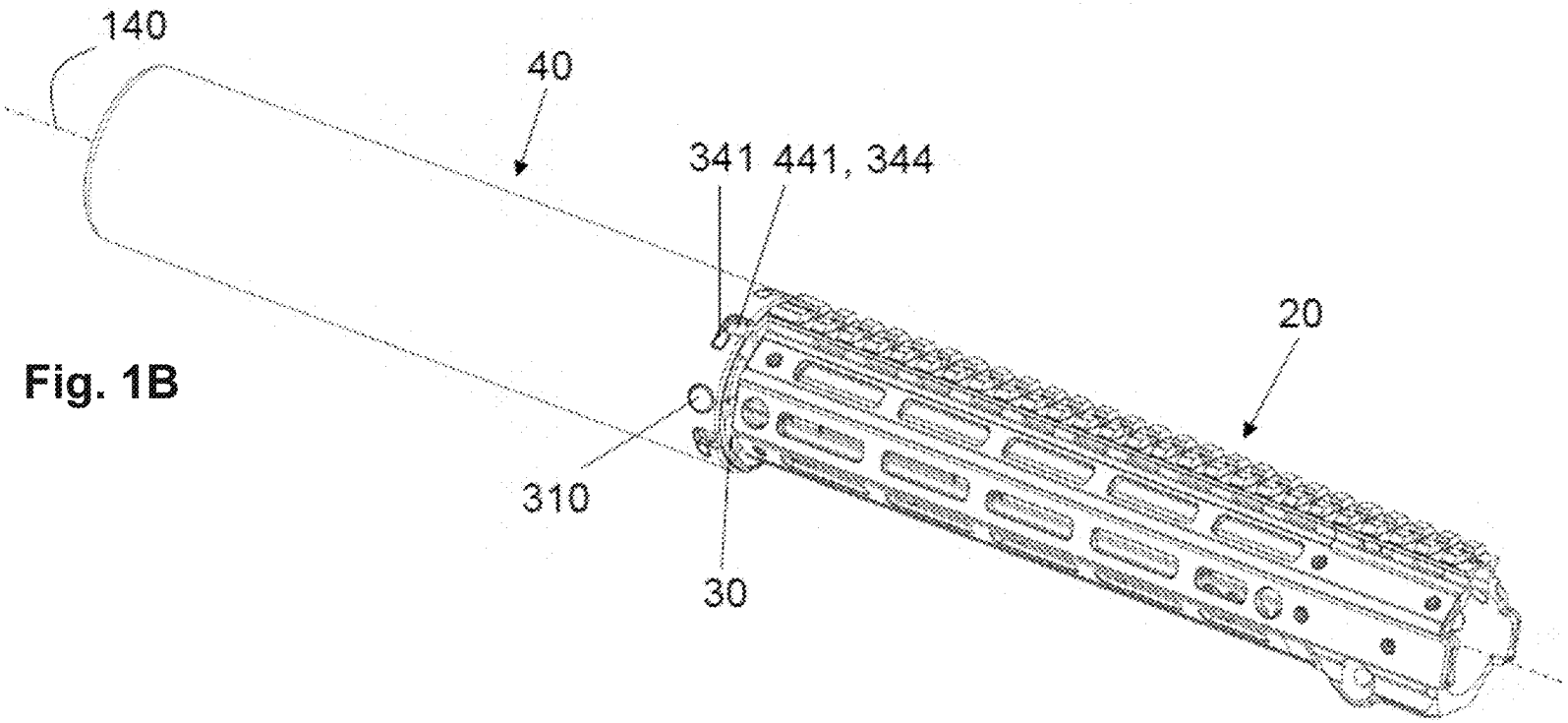
FIG. 1B is a perspective view of an accessory part on an exemplary sheath, consistent with the present disclosure.

FIG. 1B is a schematic oblique view of an adapted accessory part 40 on the sheath 20. In this view, the coupling of the accessory part can be identified by a sliding and rotary connection in the manner of a "bayonet attachment," which is formed by bayonet locks 341 and correspondingly formed bayonet notches 441 of the accessory part 40.

Furthermore, FIG. 1B shows a preferred embodiment, in which a spring-loaded push button 310 engages, in the radial direction towards the outside, in corresponding holes 425, for the purpose of securing against unintentional rotation of the accessory part 40.

Figure 3:
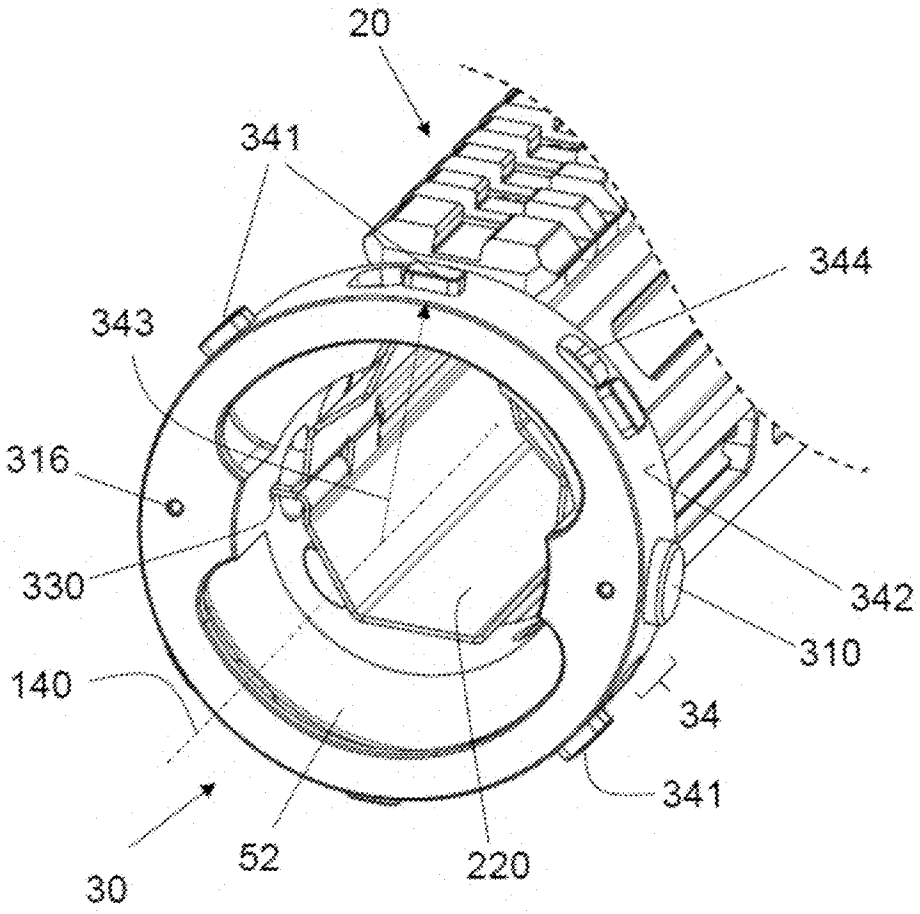
FIG. 3 shows an exemplary adapter on a sheath in an enlarged detail.
Figure 4:
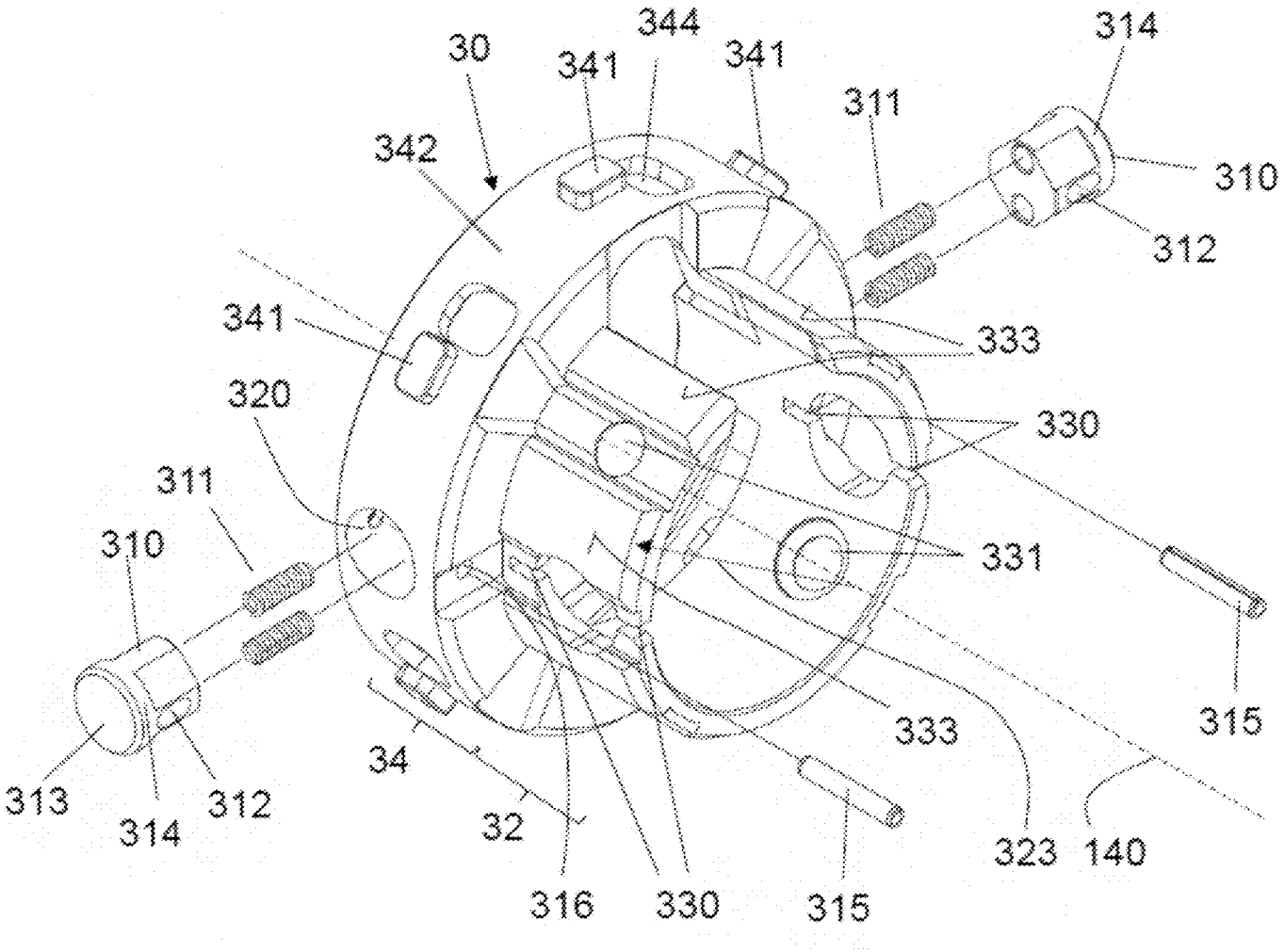
FIG. 4 is a perspective exploded view of an exemplary adapter of the present disclosure.

Moreover, FIG. 1B, in conjunction with FIGS. 3, 4 and 6, shows a particularly preferred embodiment, according to which the adapter 30 comprises, on the front portion 34, at least one adapter opening 344 that preferably adjoins the at least one bayonet lock 341, in the peripheral direction. This forms inter alia additional ventilation holes in the coupling region.

The accessory part 40 comprises a plurality of L-shaped bayonet recesses 430 which originate from the edge of the accessory 40 facing the weapon. The bayonet recesses 430 can in principle also be formed so as to be arcuate. Although this embodiment is not shown, a person skilled in the art having the benefit of the present disclosure would understand that an arcuate design makes it possible for bracing to be achieved in the direction of the adapter 30, by means of the turning movement of the accessory part 40.

In the preferred embodiment, the at least one bayonet notch 430 is L-shaped, comprising a first limb which extends in parallel with the barrel axis 140, proceeding from the edge of the end on the weapon side, and a second limb which is designed so as to extend in the peripheral direction, following said first limb.

Figure 2:
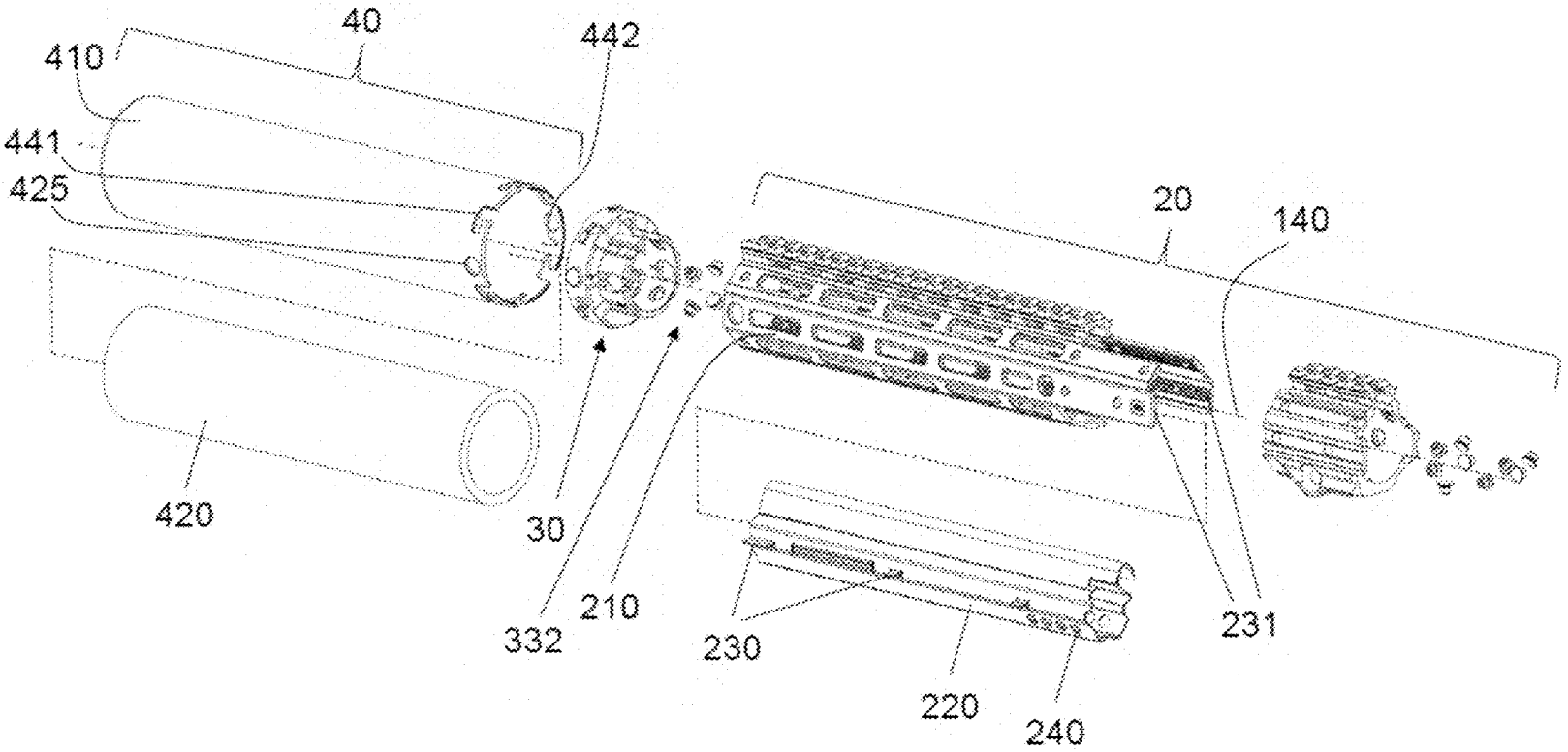
FIG. 2 is an exploded view of the parts of the firearm of FIG. 1A.

FIG. 2 is an exploded view of the components shown in FIG. 1B. Said components can, in principle, also be formed integrally on the handguard 20 in order to form the front stock, FIG. 2 showing an example for a plurality of components that form the sheath 20.

In addition to the handguard 210 just mentioned, or the sheath 20, FIG. 2 shows a heat shield 220 which is intended for being accommodated inside the handguard 210. Heat shield guide extensions 220 can be seen laterally, on said heat shield 220, which extensions are used for guidance or mounting in the handguard 210. Upon closer inspection of these illustrations, it is possible to see a plurality of guides 231 on the inside of the handguard 210. The heat shield 220 can be inserted along said guides 231 and is guided using the guide extensions 230 and retained at a defined distance from the barrel 10 or the handguard 210, as is particularly clear in conjunction with FIGS. 3 and 5 and will be explained in further detail in the following. Said guides 231 can be formed as notches or other functionally equivalent protruding double strips, in order to form a corresponding rest and guide for the guide extensions 230.

Furthermore, FIG. 2 shows a plurality of screws 332 which are used for fastening the adapter 30 to the handguard 210, in the region of the rear portion 32.

In a preferred embodiment, viewed from the outside the handguard 210 comprises a "right-hand thread," and the screws 332 are formed in the stock as a type of countersunk bolt comprising a tool receptacle, e.g. a hex key or Torx. In this manner, the screws 332 can be screwed onto the handguard 210 in a manner penetrating outwards, from the inside of the adapter 30, in the radial direction, in the region of the rear portion 32, in that a screwdriver is moved to the "left," from the outside, and thus draws the adapter 30 "outwards" on the handguard 210, in the region of the contact face 333 thereof. This "inverted screw" method is advantageous in that no screw heads are located on the outside, and the outer contour of the handguard 210 remains unaffected. Furthermore, this is a relatively loss-proof manner of attaching the screws.

As can be seen in FIG. 3, which shows the adapter 30, mounted on the sheath 20, obliquely towards the front, depending on the perspective, the adapter 30 preferably has a generally annular or generally tubular structure. The front portion 34 is designed so as to be substantially annular, for the purpose of attaching the accessory 40, while the shape of the rear portion 32 recreates the inner contour of the handguard 210 that is to be contacted, as is clear in conjunction with FIG. 4. When considering FIG. 4, it quickly becomes clear to a person skilled in the art that forming extensions that protrude from the front portion 34 on the weapon side would be sufficient for ensuring good attachment to the handguard 210.

FIG. 4 shows that the rear portion 32 has smaller dimensions in the radial direction 323, proceeding from the barrel axis 140 to the contact surfaces 333 which, in the mounted state, are in planar abutment on complementary inner surfaces of the handguard 210.

The radial dimensions 323, 343 can also be approximately the same, or, in exceptional cases, it is even possible for the rear radial distance 323 from the contact surface 333 to be smaller than the front radial distance 343 from the coupling surface 342. Owing to the shape of the handguard 210 and the accessory 40, it is left to a person skilled in the art to optimally adjust the dimensions, having the knowledge provided by the disclosure.

The examples shown illustrate the preferred stepped design of the adapter 30, the distance, in the radial direction 343, from the coupling surface 342, being designed so as to be larger in the front portion 34 than in the rear portion 32. This is very clear in conjunction with FIG. 3, and makes it possible for the outer contour of the entire weapon, in the front region, i.e. the accessory part 40 and the handguard assembly 20 (=sheath), to be designed so at to be at least substantially flush, on the upper face. The significant advantage of this is that a sight, optical/thermal aiming devices, and the like, do not protrude beyond the sight line of the upper edge of the weapon. A further advantage of the stepped structure of the adapter 30 is that, when mounting the adapter 30 on the handguard 210, the lateral clamping pin holes 316 which are clearly visible in FIG. 4 are covered, and it is thus possible to reduce the risk of undesired release during use.

In general, the coupling surface 342 is in the shape of portions of lateral surfaces of at least one circular cylinder, having the barrel axis 140 as the center of the circle, and, when the accessory 40 is mounted, is in planar contact with at least one inner surface of the accessory 40 which is formed as a counter-coupling surface 442. In this case, planar abutment or planar contact are to be seen and understood in technical, and not mathematical, terms.

In the region of the coupling or counter-coupling surfaces 342, 442, the accessory part 40 and the adapter 30 comprise a bayonet attachment, which is known per se, as can be clearly seen in particular in FIG. 2. In this manner, the accessory part 40 can be easily plugged and twisted onto the adapter 30, without the muzzle attachment 111 (FIG. 5A), a silencer in the embodiment shown, contacting this. It is of course possible to provide supports if desired.

In a particularly preferred embodiment, a plurality of adapter openings 344 is formed on the front portion 34 of the adapter 30, which openings are arranged in the barrel direction 140 and/or peripheral direction such that, when the accessory part 40 is coupled, i.e. in the closed state of the bayonet attachment, at least a portion of the bayonet notch 441 and the adapter openings 344 are arranged one above the other. This situation can be seen very clearly in FIG. 1B and in FIG. 6, and provides better ventilation of the coupling region. As explained in the following, improved ventilation of the accessory part is also possible.

Furthermore, it is particularly preferable to arrange at least two adapter openings 344, which are each arranged at an angle of at least 15° with respect to an imaginary line upwards, in the vertical direction. It is also possible for a plurality of adapter openings 344 to be formed over the periphery, in particular on the underside, for improved air supply, although the upper region, when the firearm is held horizontally should not be penetrated by an adapter opening 344. This arrangement of the adapter openings 344 is suitable for minimizing what is known as the "mirage effect," i.e. the turbulence of heated air, which can be disadvantageous when looking through a sight.

The mounting is preferably fixed, as shown, by means of at least one, preferably two, spring-loaded push buttons 310. Said buttons are pre-loaded outwards, in the radial direction, by means of at least one spring 311, and can latch into locking holes 425 in the accessory 40, when the bayonet latching is completed by engagement and twisting of the bayonet extensions 341 into the bayonet notches 441. The locking is released by pushing in the push buttons 310, and the accessory 40 can be easily removed by means of rotation and removal of the sheath 20 or the adapter 30.

As can be seen in FIG. 4, it is also possible for two springs 331, located in spring bores, to be provided per push button 310, between which springs (in the mounted state) a slot 312 oriented so as to be in parallel with the barrel bore axis, is arranged. Said slot is designed so as to be elongate in the radial direction (with respect to the barrel bore axis), and a pin, preferably a clamping pin 315, protrudes into said slot, which pin limits the radial mobility of the push button 310 on both sides. In this way, the radial deflection of the push button 310 can take place within limits, and mounting/dismantling of the accessory 40 can be carried out essentially without tools.

In accordance with the demands, the adapter 30 is fastened to the sheath 20 by the existing sheath, but in any case preferably in the engagement region of the contact surface(s)

333 by means of screws 332. Said screws pass through the screw holes 331, as explained above with reference to the description of FIG. 2, and, together with the contact surfaces 333 establish a mechanically reliable connection between the two components. Guides 330 are provided for a heat shield 220 that can optionally be used, as described above.

In this manner according to the disclosed invention, the problems of the prior art are solved because all forces and moments which act on the accessory 40 or arise due to the accessory 40 (inert forces) are transferred not to the barrel 10, but instead directly to the sheath 20 ("handguard assembly").

A further very positive effect of this mounting according is made clear by the combination of FIGS. 5 and 6. The annular and stepped structure of the adapter 30 makes it possible for air to flow in from the outside, through the handguard 210, and to be conducted past, in or on the muzzle attachment 111, so as to pass through the adapter 30 in a substantially axial and/or radial manner.

Figure 5A:
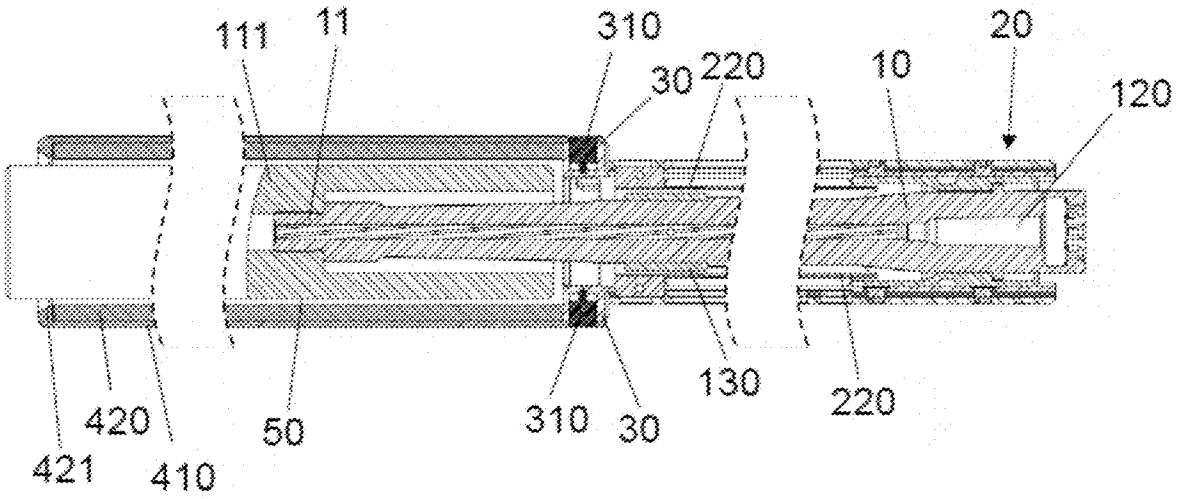
FIG. 5A is a cross section view through the barrel axis in the mounting region of the firearm of FIG. 1A.
Figure 5B:
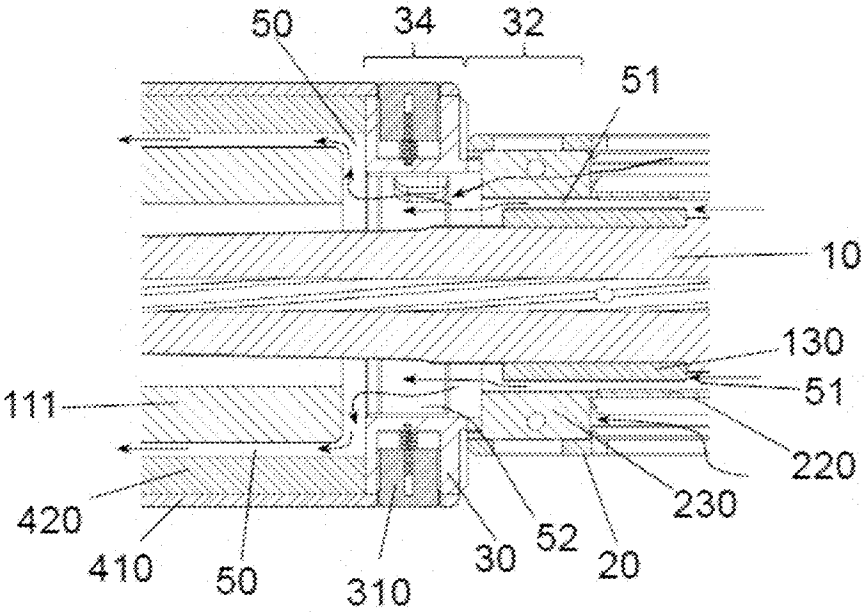
FIG. 5B is an enlarged detail of the cross section view of FIG. 5A.

FIGS. 5A and 5B show, by way of example, a silencer as the muzzle attachment 111, which is mounted directly on the muzzle 11. Therefore, a silencer cover ("suppressor cover") is shown as the accessory part 40, which comprises a shroud ("cover") 410 which comprises a stop 421 on the front end thereof. As a result, when the bayonet attachment 341, 441 is latched in, a filling 420, which is optionally provided and may for example be an insulating jacket consisting of fiberglass or the like, is clamped against the adapter 30. In this case, an (air) gap 50 remains between the shroud 410 or the filling 420, allowing for an "air draft" past the silencer. The measures set out allow for more efficient cooling than in the prior art, and delay the heating of the cover or shield of the silencer, as a result of which the thermal signature is reduced.

Furthermore, as is clear from the combination of FIGS. 3, 4, and 6, the substantially tubular structure of the adapter makes it possible for the connection space 52 between the adapter 30 and the barrel 10 to remain free. Furthermore, it is clear from FIG. 5*b* that the heated air at the barrel 10 is guided in the intermediate space 51 to the heat shield 220. The supply air from "outside" through the handguard 210 makes it possible to reduce heat accumulation in the connection space 52, leading to an increase in the cooling effect at the barrel 10 and delaying heating of the handguard 210.

The specified supply of air can, as explained above, be supplemented by the function of the adapter openings 344 which are possibly provided and are arranged in an optimal manner.

Figure 6B:
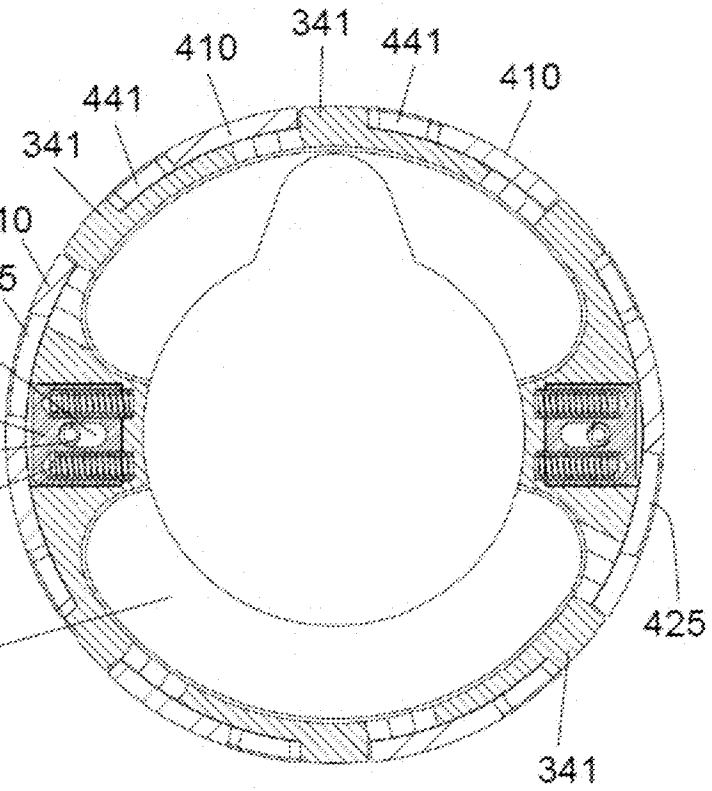
FIG. 6B is a cross section perpendicular to the barrel axis of the firearm of FIG. 1A in a different locking position.
Figure 6A:
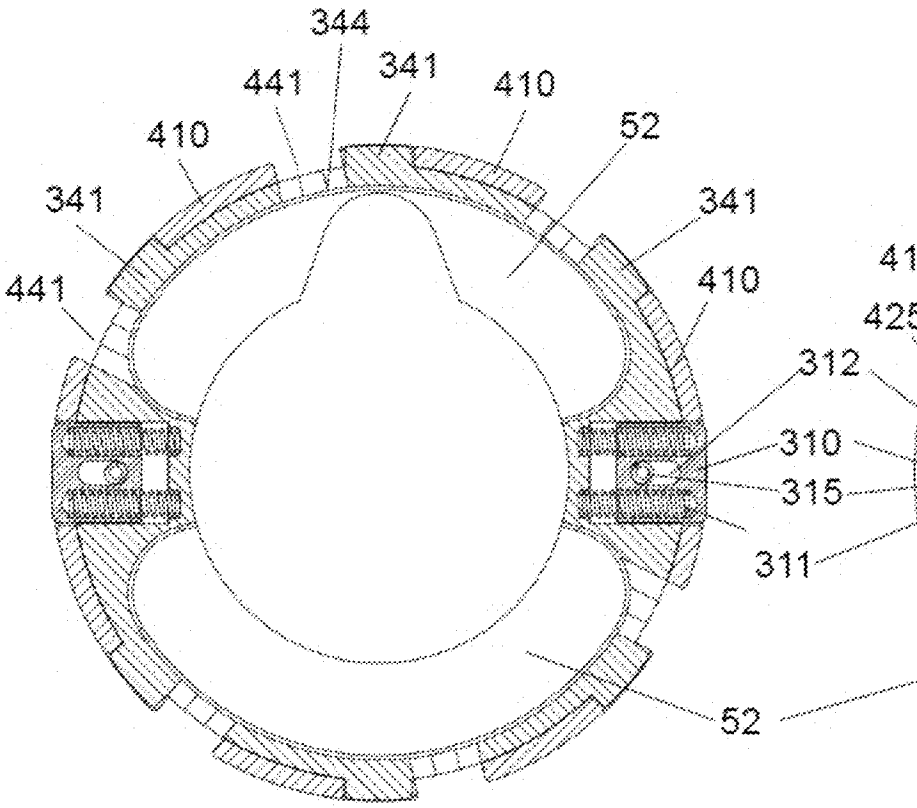
FIG. 6A is a cross section perpendicular to the barrel axis of the firearm of FIG. 1A.

FIGS. 6A and 6B are cross sections perpendicular (normal) to the barrel axis 140, through the adapter 30, in the fixed position of the accessory 40, in FIG. 6A, and following placement, but prior to twisting or locking, of the bayonet attachment 341, 441, in FIG. 6B.

Taking into account the explanations above, in particular relating to FIG. 2, a particularly effective solution simultaneously solves the heat dissipation problem for the barrel 10, in one embodiment of the invention, by a corresponding shape of the adapter 30. FIG. 3 is an oblique view of the adapter 30 fastened to the sheath 20. Inside the handguard 210 a heat shield 220 is arranged, which is shown in FIG. 2 in the state ready for insertion. Said heat shield 220 has, as intended, only a few contact points or lines, in the form of guide extensions 230, which contact the sheath 210 on the inside thereof, in guides 231 provided therefor. In this embodiment, the adapter 30 comprises the already mentioned separate shield guides ("heat shield guide") 330 (FIG. 3, FIG. 4), which optionally receive the front(most) guide extensions 230. As a result, when the adapter 30 is mounted on the sheath (handguard) 210, the heat shield 220 is also oriented and positioned, in all directions (barrel direction, axial direction such that the barrel 1 is not contacted, and such that, when the weapon is moved, rattling of the heat shield 220 in the sheath 210 can be reduced.

A number of additional aspects and features of the disclosed adapter, sheaths, and accessories are presented here without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A1. Adapter (30) for mounting an accessory part (40) on a sheath (20) of an in particular automatic firearm, comprising a barrel axis (140), whereby the adapter (30) is substantially annular or tubular in shape, and comprises at least two portions (32, 34) that are arranged adjacently along the barrel axis (140), a rear portion (32) being formed, on the weapon side, so as to be geometrically complementary to the front end of the sheath (20), at least in part, and preferably such that it can be fastened thereto by means of screws (332), and a front portion (34) comprising a cylindrical coupling surface (342) on the outside thereof, for coupling of the accessory part (40), characterized in that at least one bayonet extension (341) being provided on the coupling surface (342) so as to project radially outwards, and in that at least one, preferably two, spring-loaded push button(s) (310), which are diametrically opposing with respect to the barrel bore axis (140), is/are provided on the coupling surface (342).

A2. Adapter (30) according to paragraph A1, characterized in that at least one recess for a push button (310) is provided on the coupling surface (342), which recess is penetrated by a clamping pin hole (316) that is oriented so as to be in parallel with the barrel axis (140).

A3. Adapter (30) according to paragraph A2, characterized in that the at least one push button (310) comprises a slot (312) for inserting a pin (315).

A4. Adapter (30) according to any of the preceding paragraphs, characterized in that the rear portion (32) is designed so as to be radially stepped from the front portion (34).

A5. Adapter (30) according to paragraph A3, characterized in that the rear portion (32) has smaller radial dimensions than the front portion (34).

A6. Adapter (30) according to any of the preceding paragraphs, characterized in that the rear portion (32) comprises at least two holes (331) for receiving the screwing of screws (332) in the handguard (210).

A7. Adapter (30) according to any of the preceding paragraphs, characterized in that two heat shield guides (330) for receiving heat shield guide extensions (230) of a heat shield (220) are formed on the rear portion (32).

A8. Adapter (30) according to any of the preceding paragraphs, characterized in that the front portion (34) comprises at least one adapter opening (344) which is preferably adjacent to the at least one bayonet extension (341) in the peripheral direction.

A9. Adapter (30) according to paragraph 8, characterized in that at least two adapter openings (344) are each formed so as to be at least 15° with respect to an imagined line extending upwards in the vertical direction.

A10. Sheath (20) of the barrel (10) fora firearm comprising a barrel axis (140), characterized in that the sheath (20) comprises, in the front end region, a front portion being geometrically complementary to the rear portion (32) of an adapter (30) according to any of the preceding paragraphs, and preferably such that it can be fastened thereto by means of screws (332).

A11. Sheath (20) according to paragraph A10, characterized in that the inside of the handguard (210) comprises guides (231) that are designed so as to be substantially complementary in shape to the heat shield guide extensions (230) of a heat shield (220).

A12. Sheath (20) of the barrel (10) fora firearm comprising a barrel axis (140), characterized in that its front region has the front portion (34) of the adapter (30) formed integrally on the handguard (210).

A13. Accessory part (40), in particular shield of a silencer, characterized in that a shroud (410) is formed on the end region thereof, on the weapon side, for coupling to an adapter (30) according to any of paragraphs A1 to A9, or a sheath (20) according to paragraph A12.

A14. Accessory part (40) according to paragraph A13, characterized in that a circular cylindrical counter-coupling surface (442) for coupling to the coupling surface (342) of the adapter (30) is formed, which counter-coupling surface comprises at least one, preferably L-shaped, bayonet notch (441).

A15. Accessory part (40) according to paragraph A14, characterized in that the at least one bayonet notch (441) comprises a first limb which extends in parallel with the barrel axis (140), proceeding from the edge of the end on the weapon side, and a second limb which is designed so as to extend in the peripheral direction, following said first limb.

A16. Accessory part (40) according to any of paragraphs A13 to A15, characterized in that at least one, preferably two, locking hole(s) (425) corresponding to at least one push button (310) is/are formed.

The disclosed invention is not restricted to the exemplary embodiments that are shown and described, but can instead be adapted and designed by a skilled artisan in a different manner. In particular, the invention relates not only to an accessory part 40 that is designed according to the disclosure, but also to the adapter 30 per se, and also a weapon provided with an adapter of this kind.

Therefore, in addition to the adapter 30 designed according to the invention, accessory parts 40 that are correspondingly matched to an adapter 30 designed in this manner also fall within the scope of the present disclosure.

Finally, in the case of "new" weapons, the part of the adapter 30 on the weapon side may be a part of the handguard 210, such that the part of the adapter 30 having the lager radius, together with the bayonet attachment, is formed integrally on the front end of said weapons. Put simply, the adapter 30, as a separate component, can be omitted, more exactly the rear portion 32 is omitted, and the front portion 34 of the adapter 30 is formed integrally on the handguard 210.

As explained above, some aspects of the the present invention make it possible for the mechanical stability of the attachment of an accessory part, the precision of the weapon, as well as the heat dissipation at the barrel and/or a muzzle attachment to be improved, and nonetheless for a reduction of the thermal signature to be achieved.

In the description and the claims, the terms "front," "rear," "upper," "lower," etc., are used in the generally accepted manner and with reference to the subject matter in the conventional use position thereof. That is to say that, in a weapon, the muzzle of the barrel is at the "front," the slide is moved to the "rear" by means of the explosion gases, etc.

It should also be noted that, in the description and the claims, specifications such as "lower region" of an object means the lower half, and in particular the lower quarter, of the overall height, and "lowest region" means the lowest quarter and in particular an even smaller part; while "central region" means the central third of the overall height (width–length). All these specifications are used in their generally accepted meaning, applied to the intended position of the object in question.

In the description and the claims, "substantially" means a deviation of up to 10% of the specified value, if physically possible both upwards and downwards, but otherwise only in the reasonable direction, and in the case of degree specifications (angle and temperature) this means±10°.

Unless otherwise specified, the term "combination" or "combinations" means all types of combinations, from two of the components in question to a plurality or all of components of this kind, and the term "containing" also means "consisting of."

The features and variants specified in the individual embodiments and examples can be combined freely with those of the other examples and embodiments, i.e. without the other features of the relevant example, and can in particular be used for characterizing the invention in the claims, without necessarily incorporating the other features/details of the relevant embodiment or of the relevant example.

Listing of Reference Numerals

| | | | |
|---|---|---|---|
| 10 | barrel | 30 | adapter |
| 11 | muzzle | 310 | push button |
| 12 | housing (receiver) | 311 | spring |
| 13 | stock (butt stock) | 312 | groove/slot |
| 14 | grip | 313 | pressure surface (push surface) |
| 111 | muzzle attachment | 314 | locking surface (locking area) |
| 120 | cartridge chamber | 315 | clamping pin (locking pin) |
| 130 | gas block | 316 | clamping pin hole (locking pin hole) |
| 140 | barrel axis | | |
| | | 32 | rear portion (rear section) |
| 20 | sheath, overall (handguard assembly) | 320 | recess for push button (button recess) |
| 210 | handguard | 323 | rear radial distance |
| 220 | heat shield | 330 | heat shield guide |
| 230 | heat shield guide extension | 331 | screw holes towards handguard |
| 231 | guide | 332 | screws |
| 240 | ventilation holes (vent holes) | 333 | contact surface for handguard |
| 40 | accessory | 34 | front portion (front section) |
| 410 | shroud (cover) | 341 | bayonet extension (bayonet lock) |
| 420 | filling | 342 | coupling surface |
| 421 | stop | 343 | front radial distance |
| 425 | locking hole (button hole) | 344 | adapter opening |
| 441 | bayonet notch | | |
| 442 | counter-coupling surface | 50 | gap |
| | | 51 | intermediate space (spacing) |
| | | 52 | connection space (connection chamber) |

What is claimed is:

1. An adapter for mounting an accessory on a sheath of a firearm, where the firearm defines a barrel axis, the adapter comprising:

at least two portions that are arranged adjacently along the barrel axis; the at least two portions including a rear portion configured to be adjacent the firearm and formed so as to be geometrically complementary to at least a portion of a front end of the sheath; and a front portion configured to be adjacent the accessory, including a cylindrical coupling surface on an outside of the front portion, and configured to couple with the accessory;

wherein the adapter is substantially annular or tubular in shape, and includes at least one bayonet extension on the cylindrical coupling surface that projects radially outwards, and at least one spring-loaded push button on the coupling surface; and wherein the adapter further comprises at least one recess in the coupling surface for receiving the at least one spring-loaded push button, and the recess is penetrated by a clamping pin hole that is oriented so as to be parallel with the barrel axis.

2. The adapter of claim 1, wherein the adapter includes two spring-loaded push buttons on the coupling surface, where the two spring-loaded push buttons diametrically oppose one another with respect to the barrel axis.

3. The adapter of claim 1, wherein the rear portion of the adapter is configured to be fastened to the front end of the sheath by one or more screws.

4. The adapter of claim 1, wherein the at least one spring-loaded push button defines a slot for inserting a pin.

5. The adapter of claim 1, wherein the rear portion is radially stepped from the front portion.

6. The adapter of claim 5, wherein the rear portion has a smaller radial dimension than the front portion, and is radially stepped inwardly from the front portion.

7. The adapter of claim 1, wherein the sheath includes a handguard, and the rear portion of the adapter defines at least two holes for receiving screws for screwing into the handguard.

8. The adapter of claim 1, wherein the sheath includes a heat shield, and the rear portion of the adapter further comprises two heat shield guides configured to receive corresponding heat shield guide extensions of the heat shield.

9. The adapter of claim 1, wherein the front portion of the adapter defines at least one adapter opening.

10. The adapter of claim 9, wherein the at least one adapter opening is adjacent to the at least one bayonet extension in a peripheral direction.

11. The adapter of claim 10, wherein the front portion of the adapter defines at least two adapter openings, and each adapter opening is formed so that the opening extends at an angle of at least 15° from an imagined line extending upwards in a vertical direction.

12. The adapter of claim 1, wherein the adapter is configured for mounting the accessory on the sheath of a firearm that is an automatic rifle.

13. A sheath for a barrel of a firearm, where the firearm defines a barrel axis, the sheath comprising:

a sheath front portion that is geometrically complementary to a rear portion of an accessory adapter;

wherein the adapter includes at least two portions that are arranged adjacently along the barrel axis; the at least two portions including a rear portion configured to be adjacent the firearm and formed so as to be geometrically complementary to at least the front portion of the sheath; and a front portion configured to be adjacent an accessory, including a cylindrical coupling surface on an outside of the front portion, and is configured to couple with the accessory;

wherein the adapter is substantially annular or tubular in shape, and includes at least one bayonet extension on the cylindrical coupling surface that projects radially outwards, and at least one spring-loaded push button on the coupling surface; and wherein the adapter further comprises at least one recess in the coupling surface for receiving the at least one spring-loaded push button, and the recess is penetrated by a clamping pin hole that is oriented so as to be parallel with the barrel axis.

14. The sheath of claim 13, wherein the sheath is configured to have the rear portion of the adapter fastened to the sheath front portion by one or more screws.

15. The sheath of claim 13, wherein the sheath further comprises a handguard, wherein an inside of the handguard includes one or more guides configured to be substantially complementary in shape to one or more corresponding heat shield guide extensions of a heat shield.

* * * * *